United States Patent [19]

Meisner et al.

[11] Patent Number: 4,544,813

[45] Date of Patent: Oct. 1, 1985

[54] INDEXING PLATE FOR A TIME SWITCH

[75] Inventors: Alfred Meisner; Alfred-Günther Lunz, both of Nuremberg, Fed. Rep. of Germany

[73] Assignee: Diehl GmbH & Co., Fed. Rep. of Germany

[21] Appl. No.: 618,929

[22] Filed: Jun. 11, 1984

[30] Foreign Application Priority Data

Jun. 15, 1983 [DE] Fed. Rep. of Germany ..... 3321539

[51] Int. Cl.[4] ..... H01H 7/00

[52] U.S. Cl. ..... 200/38 R; 74/568 T

[58] Field of Search ..... 74/568 T; 200/35 R, 200/38 B, 38 BA, 38 C, 38 CA, 38 D, 38 R, 39 R; 307/141

[56] References Cited

U.S. PATENT DOCUMENTS 4,109,119 8/1978 Baelz et al. ..... 200/38 CA

*Primary Examiner*—A. D. Pellinen
*Assistant Examiner*—Morris Ginsburg
*Attorney, Agent, or Firm*—Scully, Scott, Murphy & Presser

[57] ABSTRACT

An indexing plate for a time switch including slide contacts at the circumference of the indexing plate which are radially displaceable from an inoperative position to latch into at least one switching position, which incorporate an actuating projection and a switching finger opposite thereto, and which are conducted between the projection and the finger through slots in the indexing plate. The switching fingers are spaced from each other at the circumference of the indexing plate and evidence a rim area and a switching edge, in whose path of movement there is located a switching element of a switch contact in the actuated or switching position. Guide walls are formed on the indexing plate for each switching finger, in that rim edges are provided on the guide wall which, in the inoperative position of every switching finger align essentially planar with the switch edges thereof, and that in the switched-on position of every switching finger, the switch edge thereof will radially overhang the rim edges, and of which the rim region is located intermediate the guide walls. Inasmuch as the switch element radially contacts the switch edge, the lift of the slide contacts can be small from their inoperative position into a switching position.

8 Claims, 2 Drawing Figures

INDEXING PLATE FOR A TIME SWITCH

BACKGROUND OF THE INVENTION

1. Field of the Invention

The present invention relates to an indexing plate for a time switch including slide contacts at the circumference of the indexing plate which are radially displaceable from an inoperative position to latch into at least one switching position, which incorporate an actuating projection and a switching finger opposite thereto, and which are conducted between the projection and the finger through slots in the indexing plate, wherein the switching fingers are spaced from each other at the circumference of the indexing plate and evidence a rim area and a switch edge, in whose path of movement there is located a switching element of a switch contact in the actuated or switching position.

2. Discussion of the Prior Art

An indexing plate of that type has become known from the disclosure of German Petty Pat. No. 76 27 289. In such an indexing plate, the contacting of the switching fingers is carried out below the indexing plate. The switching fingers freely overhang the indexing plate so as to be only slightly stiff because their narrow wall thickness. This leads to the result that appreciable tolerances or offsets can occur with regard to the switching timepoint.

In the indexing plate pursuant to the abovementioned German Petty Pat. No. 76 27 289 the switching fingers are contacted from below thereof. The switch edge of the switching fingers extends radially towards the indexing plate, in which the direction of displacement of the slide contacts lies perpendicular to the switching path of the switching element. A necessary constructional width of the switching element hereby requires a minimum lift for the displacement of the contact sliders, which cannot be reduced without further measures. An increase in the lift is also occasioned by a starting incline on the switching finger.

Furthermore, also disadvantageous in the indexing plate pursuant to the above-mentioned German Petty Pat. No. 76 27 289 is that a finally unavoidable impact or tolerances in the axial direction will change the manipulation of the switching element, which can also lead to offsettings in the provided switching timepoints.

The switching element in the German Petty Pat. No. 76 27 289 slides ahead of the slide contacts which are in their inoperative position over the open slots in the indexing plate. This increases the resistance to actuation.

In German Laid-open Patent Application No. 30 19 325 there is described an indexing plate for a time switch. In this prior art structure, the slide contacts are contacted in either an axial or radial direction. At contacting scanning in the radial direction, an axial play of the indexing plate becomes barely noticeable inasmuch as the switch edge is located axially parallel. In the arrangement pursuant to German OS No. 30 19 325, the slide contact does not possess any switching finger which would project through a slot in the indexing plate. The slide contact is conveyed between oppositely facing grooves of two rings. This leads to the result that every rotational displacement of the two rings relative to each other causes a clamping of the slide contacts. Since the grooves are at least partly outwardly open, any fouling or contamination will also lead to difficulties in the operating of the slide contacts.

It is particularly disadvantageous in the indexing plate pursuant to the above-mentioned German OS No. 30 19 325, that the switching element must be acted upon by the manipulating projections on the slide contacts, since thereby the switching element will, in every instance, be located within a region which must be held accessible for the user.

SUMMARY OF THE INVENTION

Accordingly, it is an object of the present invention to so construct an indexing plate of the above-mentioned type as to render possible a reduction in the lift of the slide contacts and in which there is obtained a precise switching action at the switching timepoint.

Inventively, the foregoing object is achieved by means of an indexing plate of the above-mentioned type, in that the switching element contacts radially against the switch edges, wherein guide walls are formed on the indexing plate for each switching finger, in that rim edges are provided on the guide walls which, in the inoperative position of every switching finger align essentially planar with the switch edges thereof, and that in the switched-on position of every switching finger, the switch edges will radially overhang the rim edges, and of which the rim region is located intermediate the guide walls.

Inasmuch as the switching element radially contacts the switch edge, the lift of the slide contacts can be small from their inoperative position into a switching position. This is purposeful since this will render easier the manipulation of the slide contacts or riders, which must usually be effected by means of a fingernail. A smaller lift also allows the index plate to be so designed that its slide contacts possess two switching positions, inasmuch as then the switching lift which is of necessity larger for the second switching position than for the first switching position, can still always remain small. The guide walls provide a stop for the switching finger at both sides thereof, so that the latter also in its switching position will not be imparted any significant offset or displacement during impact against the switching element. Maintained thereby precisely is a preset switching timepoint. Within the context of achieving reduction in the required switching lift or stroke of the slide contacts, it is also applicable that the rim edges of the guide walls, in the inoperative position of the slide contacts, with align their switch edges. Hereby, a retraction of the switch edges behind the rim edges would signify an increase in the lift. The alignment of the rim edges with the switch edges in the inoperative position of the slide contacts additionally provides the result that the switch element will easily glide over rim edges and the switch edges.

By means of the invention there is eliminated the need for any approach incline or run-on surface of the switching finger. Because of the radial impact or striking of the switch element, every slide contact can then also be radially displaced when the switch element is positioned thereagainst. The elimination of the run-on surface additionally acts in the context of a reduction in the necessary lift of the slide contacts.

Inasmuch as the switching fingers are inherently guided with respect to the manipulating projections, there is avoided any guidance-required prestressing of the manipulating projections. A certain degree of movability of the manipulating projections with regard to the switching fingers, with which there must be calculated since the slide contact are plastic material components, whose manipulating projections are thicker then the switching fingers, does not influence the preset switching timepoints. Moreover, the handling of the manipulating projections is in no manner hindered by the parts of the switch contacts located at the outer circumference or the inner circumference thereof.

In a preferred embodiment of the invention, the switch edges and the rim edges extend axially-parallel relative to each other.

Achieved thereby is that, not because of an expected impact or a tolerance of the indexing plate relative to the switching element in the axial direction, need there be increased the necessary lift for the manipulation of the switch contact and as a result also the lift of the slide contacts. Preferably, the edge of the switching finger in the rim region which lies opposite the switching edge also extends axially-parallel.

In an advantageous embodiment of the invention, the surface of every manipulating projection which is located outwardly in the radial direction, is curved in concavely. Thereby, upon the displacement of a slide contact at the manipulating projection through the intermediary of a fingernail, the manipulating projection is imparted a guidance thereby which it does not have itself since it is less stiffly clamped into the indexing plate than is the switching finger.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
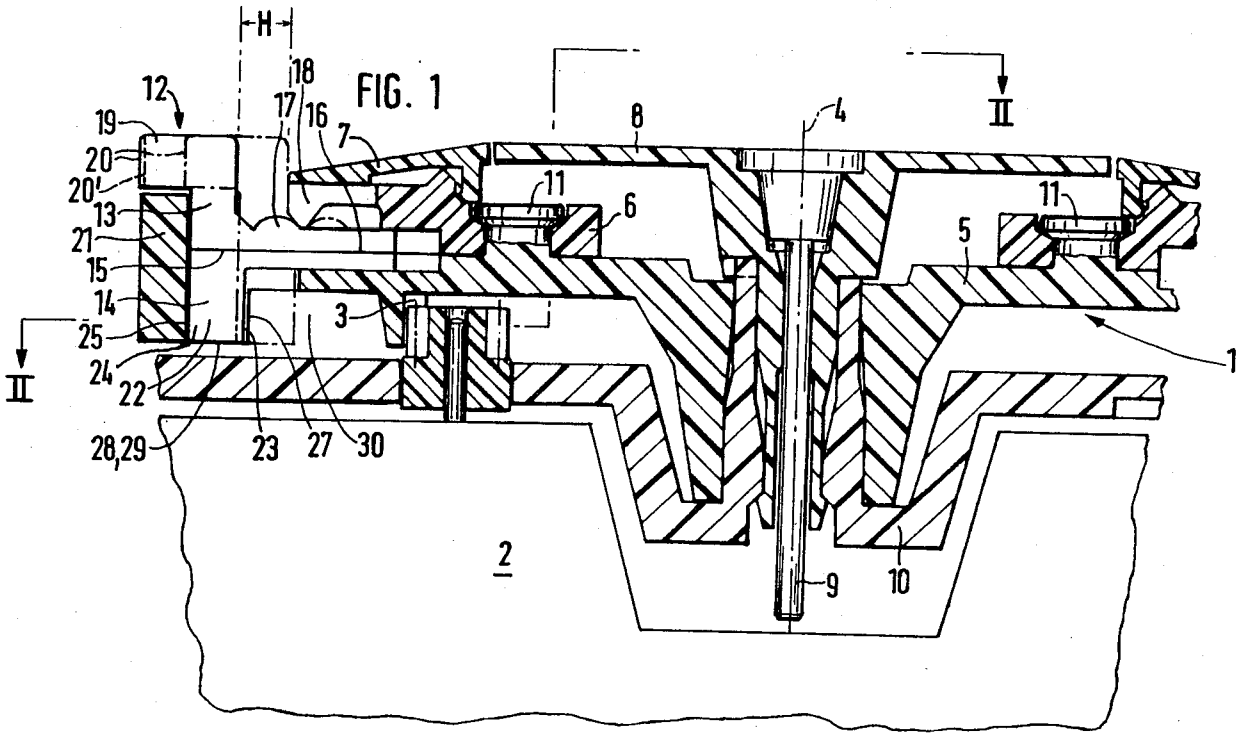
FIG. 1. illustrates a transverse sectional view through an indexing plate pursuant to the invention.

An indexing plate 1 of a time switch is driven by a clockwork mechanism 2 along an internal toothing 3. The indexing plate 1 is rotatable about an axis 4. The indexing plate includes a carrying plate 5, a locking ring 6 and a marking ring 7. By means of a holding plate 8 and a locking pin 9, the carrying plate 5 is rotatable on a cover 10 of the clockwork mechanism 2; however, is fixedly supported in an axial direction. The locking ring 6 is fixedly interconnected with the carrying disc 5 through rivets 11. The marking ring 7 is snapped aligned on the locking ring 6.

Supported at the circumference of the carrying plate 5, whose outer diameter is about 6 cm, are slide contacts or contact riders 12. For example, about the circumference, 84 slide contacts 12 may be arranged for a weekly switch which includes 12 slide contacts for each day of the week. For a daily switch, 96 slide contacts 12 would be arranged about the circumference of the carrying plate 5, having 4 slide contacts 12 for each hour of the day. The slide contacts 12, the carrying plate 5 and the locking ring 6 all are constructed of plastic material.

Figure 2:
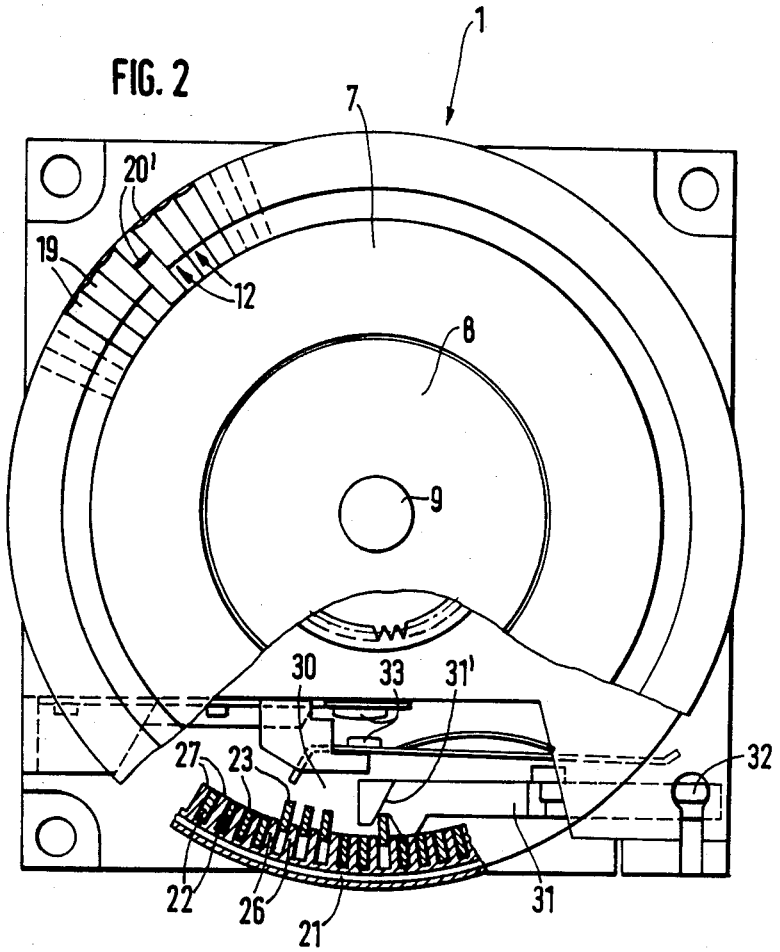
FIG. 2. illustrates a plan view, on a reduced scale, of the indexing plate shown partly in section, taken along line II—II in FIG. 1.

In an upper, outer part 13, the slide contacts 12 reduce towards the axis 4 in accordance with their number and the diameter of the carrying plate 5 so as to be positioned proximate each other without contacting (referring to FIG. 2). In contrast therewith, in the lower part 14, the thickness of the slide contacts 12 is constant and less than that in the upper part 13. For the resultingly formed radial edges 15, the carrier plate 5 incorporates guide projections 16.

At the upper portion 13 of each of the slide contacts 12 there is formed a latching bump 17. The latching bump 17 of every slide contact 12 has an elastic spring tongue 18 of the locking ring 6 associated therewith. Formed at the upper portion 13 is a manipulating projection 19. The radially outward surface 20 thereof generally aligns in the non-depressed position of the slide contact 12 (inoperative) with the outer circumference of an outer ring 21 of the carrying or support plate 5. In the depressed position of slide contact 12, the surface 20 overhangs the outer ring 21 at least slightly (referring in FIG. 1 to the phantom-line representation of the slide contact 12) so that larger dirt particles cannot enter from the outside. The outwardly directed surface, as viewed from externally, is provided with a concave indentation 20', which renders easier the manipulation of the slide contact 12 and its guidance with a fingernail.

The lower portion 14 of the slide contact 12 incorporates a switching finger 22. This finger extends axially and incorporates a switch edge 23 which is parallel with the axis 4, and in the rim region 24 located opposite thereto, an edge 25 which is also parallel with the axis 4. The switching finger 22 does not openly project inwardly, but is embedded between guide walls 26 of the outer ring 21. Hereby, each guide wall 26 possesses a rim edge 27 extending in parallel with the axis 4 which, in the undepressed position of the slide contact 12, generally aligns with the switch edge 23 of the latter. The radial extension of the switching finger 22 between the edges 23 and 25 and, correspondingly, the radial extension of the guide walls 26 up to the rim edge 27 is so dimensioned, that the rim region 24 of the switching finger 22 will then also be located between the guide walls 26 when it has been brought by the lifting distance H into its depressed position.

The extension of the guide walls 26 which is directed in parallel with the axis 4 generally coincides with that of the switching fingers 22, so that the applicable edges 28 and 29 are in alignment.

Engaging into an open annular space 30 is a resilient switch element 31 in a manner as to contact the switch edge 23 or, respectively, the rim edge 27. The pivot axis 32 of the switch element 31 is hereby located in parallel with the axis 4 (referring to FIG. 2). Connected with the switch element 31 are switch contacts 33. This initiates a desired switching sequence, when the switch element 31 is displaced from the switch edge 23 of the switching finger 22 by a slide contact 12 which is depressed from its inoperative position into a switching position.

The function of the above-described arrangement is generally as follows:

For effecting the setting of the desired switching timepoints, the applicable slide contact 12 is initially brought through depressing from its inactive or inoperative position into the switching position. This is rendered easier by the indentations 20'. The thereby required lifting distance or stroke H is small so that there is no need for concern that, inadvertently, slide contacts which are located adjacent the applicable slide contact will be moved from their inoperative positions into switching positions. Through turning of the indexing plate 1, in particular along its outer ring 21, the former is brought into conformance with the actual time.

Thereafter, the clockwork mechanism 2 will drive the indexing plate 1.

As long as the switch element 31 slides above the switch edges 23 of the undepressed slide contacts 12 and the rim edges 27 of the guide walls 26, these will not provide any high resistance to operation. When one switch edge 23 of the switching finger 22 strikes against a depressed slide contact 12 on the switch element 31, then the latter will be displaced. Inasmuch as the switching finger 22 is restrained within its rim region 24 between the guide walls 26, it is rigidly guided, so that the desired switching timepoint will extensively coincide with the actual switching timepoint. Due to the rigidity of a switching finger 22 which is brought into the switching position, any necessary run-on incline 31' of the switch element 31 can be steep; in effect, can possess a relatively small acute angle with regard to the radius, which will favorably exert itself on the switching behavior of the switch contacts 33 and the exactness of the switching.

It is advantageous that in the described arrangement, notwithstanding the small lifting distance H, the manipulating projection 19 evidences a sufficient extent of play for the manipulation, in contrast to which the switching finger 22 is guided and retained at narrower tolerances.

What is claimed is:

1. In an indexing plate and a switch element for a timeclock, said indexing plate including slide contacts at the circumference of the indexing plate which are radially displaceable to latch from an inoperative position into at least one switching position, each said slide contact having a manipulating projection and a switching finger opposite thereto and which are conducted intermediate the projection and finger through slide projections formed in the indexing plate, said switching fingers being spaced from each other along the circumference of the indexing plate and incorporate a rim region and a switch edge in the path of movement of the switch element for contacting a switch contact when said slide contacts are in the switching position thereof, the improvement comprising:

guide walls on said indexing plate for each said switching finger, said guide walls include rim edges which, in the inoperative position of each said switching finger substantially align planarly with the switch edges thereof, and wherein in the switching position of each said switching finger the switch edge thereof radially overhangs the rim edges and the rim region thereof is located intermediate said guide walls, and wherein said switch element radially strikes against the switch edge of each switching finger.

2. Indexing plate as claimed in claim 1, wherein said switch edge and said rim edge of each switching finger extend axially parallel.

3. Indexing plate as claimed in claim 1, wherein said indexing plate is rotatable about an axis and said switch element has a pivot axis which extends axially parallel to the axis of said indexing plate.

4. Indexing plate as claimed in claim 1, wherein the edge of the switching finger extends axially parallel in the rim region which is located opposite the switch edge.

5. Indexing plate as claimed in claim 3, wherein the switch edge is closer to the axis of the indexing plate than the rim region.

6. Indexing plate as claimed in claim 1, wherein each said manipulating projection has a concavely indented radially outward surface.

7. Indexing plate as claimed in claim 1, wherein the axial height of said guide walls is substantially equal to the height of the switching fingers.

8. Indexing plate as claimed in claim 1, wherein the manipulating projectons are in substantial alignment with an outer ring of said indexing plate when said slide contacts are in the inoperative position and said manipulating projections slightly overlap said outer ring when said slide contacts are in the switching position.

* * * * *